US010544675B2

(12) United States Patent
El Safty

(10) Patent No.: US 10,544,675 B2
(45) Date of Patent: Jan. 28, 2020

(54) TURBINE ASSEMBLY

(71) Applicant: C I CORPORATION PTY LTD, Southport, Queensland (AU)

(72) Inventor: Ahmed El Safty, Paradise Point (AU)

(73) Assignee: C I CORPORATION PTY LTD, Queensland (AU)

( * ) Notice: Subject to any disclaimer, the term of this patent is extended or adjusted under 35 U.S.C. 154(b) by 417 days.

(21) Appl. No.: 14/420,358

(22) PCT Filed: Aug. 8, 2013

(86) PCT No.: PCT/AU2013/000874
§ 371 (c)(1),
(2) Date: Feb. 7, 2015

(87) PCT Pub. No.: WO2014/022887
PCT Pub. Date: Feb. 13, 2014

(65) Prior Publication Data

US 2015/0233248 A1 Aug. 20, 2015

(30) Foreign Application Priority Data

Aug. 8, 2012 (AU) ..... 2012903417

(51) Int. Cl.
*F01D 1/32* (2006.01)
*F01D 25/18* (2006.01)
*F01D 25/00* (2006.01)

(52) U.S. Cl.
CPC ..... *F01D 1/32* (2013.01); *F01D 25/005* (2013.01); *F01D 25/183* (2013.01)

(58) Field of Classification Search
CPC ..... F01D 1/32
USPC ..... 415/80, 82
See application file for complete search history.

(56) References Cited

U.S. PATENT DOCUMENTS 65,154 A * 5/1867 Banta ..... F01D 1/32 415/80
103,162 A * 5/1870 Duvall ..... F03B 3/00 415/80
115,937 A * 6/1871 Cremin ..... G01F 15/08 415/80
433,727 A * 8/1890 Goff ..... F01D 1/32 415/81
469,404 A * 2/1892 Irish ..... F03B 3/08 415/82

(Continued)

FOREIGN PATENT DOCUMENTS

FR 2161317 A5 7/1973

OTHER PUBLICATIONS

International Search Report and Written Opinion issued in PCT/AU2013/000874 dated Feb. 7, 2014.

*Primary Examiner* — Mary E McManmon
*Assistant Examiner* — Richard K. Durden
(74) *Attorney, Agent, or Firm* — Acuity Law Group, PC; Michael A. Whittaker

(57) ABSTRACT

A turbine including a rotor assembly having a head adapted for engagement with a body including a passage for receipt of a fluid the passage being in communication with a flow chamber formed between the head and body on engagement of head with the body wherein the flow chamber is shaped to produce a laminar flow of the fluid out a plurality of nozzles disposed in the head.

9 Claims, 3 Drawing Sheets

(56) References Cited

U.S. PATENT DOCUMENTS

| | | | | | |
|---|---|---|---|---|---|
| 709,242 | A * | 9/1902 | Prescott | F01D 1/32 | 415/80 |
| 1,050,410 | A * | 1/1913 | Wainwright | F01B 17/02 | 415/115 |
| 1,561,835 | A | 11/1925 | Dahlstrand | | |
| 2,330,730 | A | 9/1943 | Mosshart | | |
| 2,945,619 | A * | 7/1960 | McLure | F01D 1/32 | 415/102 |
| 3,032,988 | A * | 5/1962 | Kleckner | F01D 1/32 | 415/80 |
| 3,282,560 | A * | 11/1966 | Kleckner | F01D 1/32 | 415/216.1 |
| 3,758,223 | A * | 9/1973 | Eskeli | F01D 1/18 | 415/1 |
| 3,930,744 | A * | 1/1976 | Theis, Jr. | F01B 25/02 | 415/143 |
| 4,336,039 | A * | 6/1982 | Sohre | F01D 1/32 | 239/214.21 |
| 4,768,344 | A * | 9/1988 | Stojicic | F01D 1/32 | 60/614 |
| 7,722,313 | B1 | 5/2010 | Di Iorio | | |
| 2009/0229246 | A1* | 9/2009 | Kawai | B23Q 1/38 | 60/263 |
| 2012/0009055 | A1* | 1/2012 | Kim | F01D 1/22 | 415/80 |

* cited by examiner

TURBINE ASSEMBLY

CROSS REFERENCE TO RELATED APPLICATIONS

The present invention is filed under 35 U.S.C. § 371 as the U.S. national phase of International Application No. PCT/AU2013/000874, filed Aug. 8, 2013, which designated the U.S. and claims the benefit of priority to Australian Patent Application No. 2012903417, filed Aug. 8, 2012, each of which is hereby incorporated in its entirety including all tables, figures, and claims.

TECHNICAL FIELD

The present invention relates to rotor devices and system. In particular although not exclusively the present invention relates to turbine assemblies and systems which utilise a working fluid for the generation of rotational energy.

BACKGROUND ART

The basic operation of a conventional turbine is that expanding gases or pressurised fluids e.g. vapour stream or pressurised liquid (collectively, known as working fluids) are directed onto blades or set of blades mounted around a drum or shaft. The working fluid enters the turbine chamber where it impinges on turbine blades that are mounted around a centred shaft, causing the shaft to rotate and provide useful work. The turbine shaft work is used to drive devices such as an electric generator that may be coupled to the shaft. The shaft is typically mounted in sealed lubricated bearings on a horizontal axis that are required to be cooled to avoid lubrication failure. The energy that is not used for shaft work comes out in the exhaust as spent working fluid, so these have either a high temperature or a high velocity. The movement of the high pressure working fluid and high speed rotation of the bladed turbine create a high amount of noise.

Another type of turbine used at present is the pure reaction turbine where the rotor body is mounted around a stationary working fluid inlet that is centrally located in a channel within the rotating turbine head. The rotor body is provided with peripherally mounted nozzles in fluid communication with the flow channel within the rotor body. Working fluid is introduced into the channel of this type of rotor through a centrally mounted and stationary working fluid inlet and the working fluid flows through the rotor body and out of the peripherally mounted nozzles. The nozzles are directed such that the expelled high pressure working fluid causes thrust and rotation of the rotor. As with the conventional bladed turbine, the rotor is normally coupled to a shaft in order to extract useable shaft work.

One of the main issues with each of the above described turbines and rotor is that the shafts associated with the turbine and rotor, whether the shaft is the central mounting shaft for the turbine blades in the conventional turbine or the stationary working fluid channel inlet of the of the pure reaction turbine, must be supported in some manner allowing both rotation of the shafts or the rotor and also a low friction support mechanism that does not allow the escape of the working fluid. The loss of work output due to the friction can be substantial between the (i) shaft or and its support in the case of a conventional turbine or (ii) the rotor and the stationary working fluid channel inlet for the pure reaction turbine.

In addition, the working fluid for both the above described turbines is limited to only one working fluid.

One other problem with both types of turbines is noise emissions associated with the turbulent movement, supersonic flow and impingement of the working fluid against the blades of the turbine as well as movement of the turbine blades for the conventional style of turbines or the supersonic flow, and rotor arm movement of the pure reaction turbine.

A further problem, particularly with the stationary working fluid inlet and the rotor configuration of the pure reaction turbine, is that the working fluid inlet and rotor need to be sealed to one another to prevent or at least reduce the amount of inlet working fluid losses from the rotor by means other than the peripherally mounted nozzles, which would reduce the turbine efficiency. One way in which this can be achieved is through a complex multi-part arrangement of rotating bearings and sealing members. The bearing-rotating seal configuration of the above described turbines requires frequent maintenance intervals.

Both type of turbines have limited rotational speed by design at a given temperature and pressure of a working fluid and the rotational speed cannot be adjusted without changing the blade configuration or size with respect to conventional turbines or in the case of the pure reaction turbines the rotor arms.

Clearly it would be advantageous to provide a turbine which is a capable of operation with multiple working fluids and which provides for variable rotational speed. It would also be advantageous to provide a turbine which is relatively low noise and which has reduce maintenance requirements

SUMMARY OF INVENTION

Accordingly on one aspect of the present invention there is provided a turbine said turbine including:

a rotor assembly having a head adapted for engagement with a body, said body including a passage for receipt of a fluid the passage being in communication with a flow chamber formed between the head and body on engagement of head with the body;

wherein the flow chamber is shaped to produce a laminar flow of the fluid out a plurality of nozzles disposed in the head.

Suitably, the rotor assembly is constructed form a high temperature resistant material to enable the use of multi-working fluids of varying temperatures and pressures of the turbine.

Preferably, the rotor assembly includes a working fluid inlet member for insertion into the passage, the working fluid inlet member having a centrally located channel therethrough to allow for the injection of the working fluid into the rotor assembly. Suitably the fluid inlet member is positioned within a positive displacement rotating seal provided within the passage. The positive displacement seal member will generally be an annular member with a central bore therethrough, which is attachable to the internal cavity of the rotor body to maintain the working fluid member fluid communication with the rotor body. The seal may contain a positive displacement vane that propels working fluid back into the fluid chamber. The seal may allow a small amount of working fluid into the passage to lubricate the rotor assembly.

The rotor assembly may be supported in its rotation by the fluid inlet member through its interface with the positive displacement rotating seal. The working fluid inlet member may stationary with the rotor body rotating thereon. The working fluid inlet member may contribute to the support of the rotor body in position. In a most preferred embodiment, the rotor body may be suspended from the working fluid inlet member and supported by a shaft sea assembly.

The rotor may include a spring loaded seal member. Suitably the spring loaded seal member is positioned adjacent the bottom of the rotor body and associated with the positive displacement rotating seal to prevent escape of the working fluid. Suitably the spring loaded seal assembly is in overlapping relation with a portion of the positive displacement rotating seal. This second seal member will preferably be of a type known as spring loaded seal. The spring loaded seal member may have at least one radial channel therein. Located within the radial channel will typically be a spring loaded high temperature self-lubricating plastic ring style seal assembly. The ring seal assembly will generally be multipart in order to allow for the expansion and contraction if the seal assembly during rotation.

The outer surface of the working fluid inlet member and a relatively located surface of the seal assembly or seal members may be provided with correspondingly shaped portions allowing the working fluid inlet member and the seal assembly to seal against one another but also allowing the seal assembly to rotate and be affected by centrifugal forces caused by such rotation.

Suitably the flow chamber is shaped to produce a laminar flow through the head. Preferably the chamber is contoured so as to reduce turbulence within the flow of the working fluid. The nozzles may be coupled to the flow chamber via contiguous contoured ejectors that reduce air resistance upon rotation and attribute to the noise reduction associated with breaking and collapsing air. Preferably the ejectors are located tangential to the laminar flow chamber.

The nozzles preferably are arranged in sets of opposing nozzles pairs. preferably the head of each nozzles is adjustable and may be throttled to produce a desired flow rate between a closed and fully open position. Suitably the nozzle heads are positioned so as to terminate within or adjacent the circumference of the rotor head.

The rotor head may be coupled to an output shaft. The output shaft will typically be associated with an alternator in power production applications otherwise to drive-shaft propelling any land, marine and air transport vehicle or any stationary object that requires rotational work. The output shaft will generally be cylindrical and elongated. It will typically be centrally mounted in relation to the rotor body and generally opposite the working fluid inlet member. The output shaft may typically be supported by one or more seals which may be similar in configuration to those which seal the working fluid inlet member to the rotor body.

Suitably the rotor assembly is mounted between a pair of support plates. The support plates may be coupled together via a series of support rods. The plates may be constructed form any suitable high temperature resistant material.

The reference to any prior art in this specification is not, and should not be taken as an acknowledgement or any form of suggestion that the prior art forms part of the common general knowledge.

BRIEF DESCRIPTION OF DRAWINGS

In order that this invention may be more readily understood and put into practical effect, reference will now be made to the accompanying drawings, which illustrate preferred embodiments of the invention, and wherein.

DESCRIPTION OF EMBODIMENTS

Figure 1:
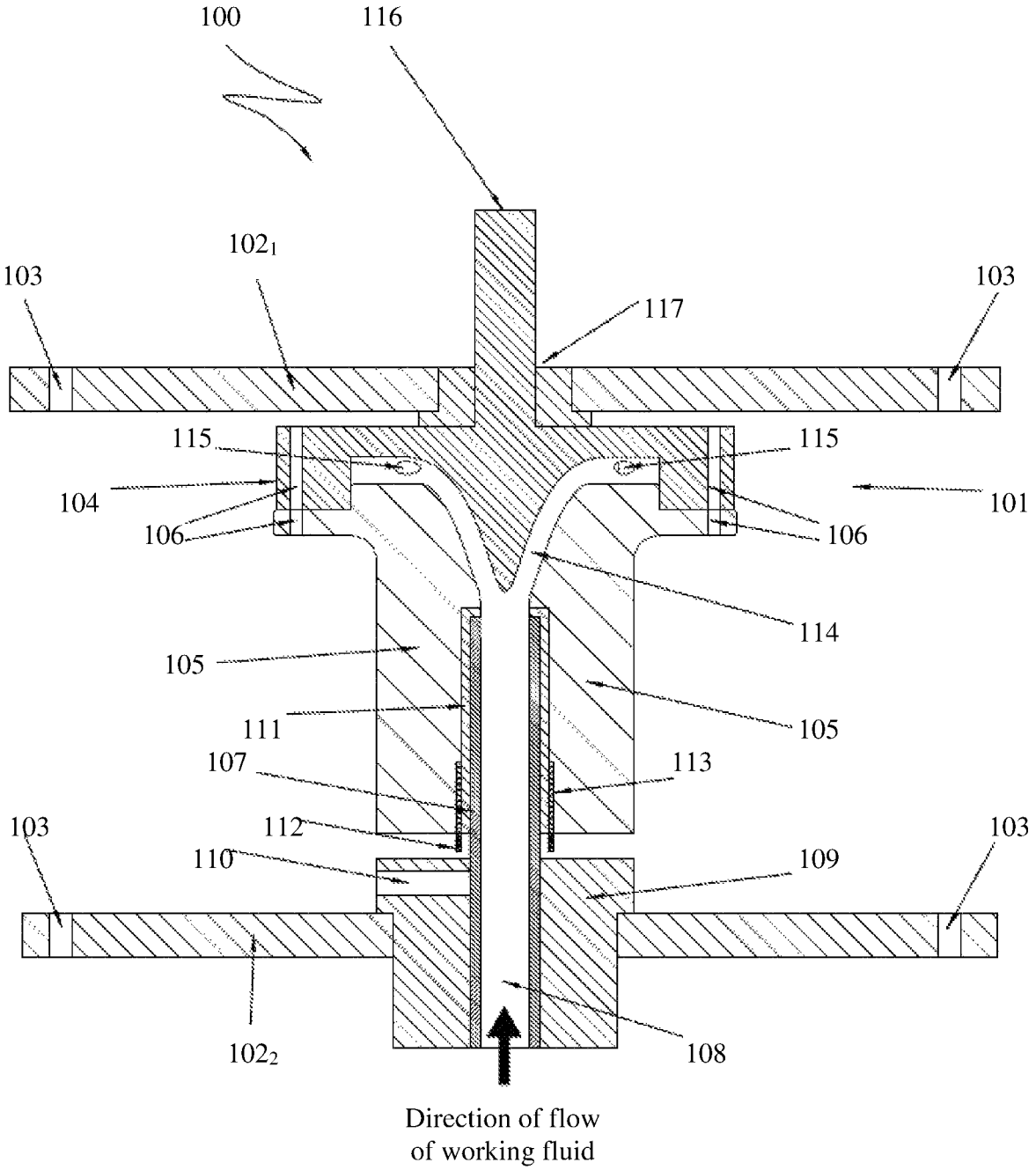
FIG. 1 is a sectional side elevation view of a rotor assembly for use in a turbine according to one embodiment of the present invention.

With reference to FIG. 1 there is illustrated one possible configuration for a rotor assembly 100 according to one embodiment of the present invention. As shown the rotor assembly 100 in this instance includes a rotor mechanism 101 disposed between support plates 1021, 1022. The plates in this example may be coupled together via a set of support rods which are fixed to each plate through apertures 103 thereby retaining the rotor mechanism 101 between the plates 1021, 1022.

The rotor mechanism 101 in this case includes head 104 and body 105. The head 104 is secured to the body 105 via the use of suitable fasteners inserted through apertures 106 to form a fluid tight seal between the head 104 and body 105. As shown the body 105 includes a passage 107 for receipt of a fluid inlet member 108 for injection of a working fluid into the head 104 of the rotor. The fluid inlet member 108 in this case is inserted into the passage 107 through inlet fixture 109 disposed in plate 1022. The inlet fixture 109 preferably includes an aperture 110 for the insertion of a grub screw or other such suitable fastener to retain the fluid inlet member 108 in position.

To prevent backflow release of the working fluid from the rotor head 104 a section of the fluid inlet 108 abutting the rotor head is retained within a rotary seal 111 disposed within passage 107. As can be seen the rotary seal 111 in this finishes sustainably flush with the base of body 105 which is set above the inlet fixture 109 such that body 105 is free to rotate on the rotatory seal 111. The rotary seal 111 in this instance contains a spiral vain which directs working fluid flow upwards toward the head 104 to reduce the potential for back flow of the working fluid through passage 107. To further reduce the potential release of the working fluid from the head 104 a ring seal 112 is provided. As shown the ring seal 112 overlaps a portion of the rotary seal 111 adjacent the base of body 105 and is held against the upper surface of the inlet fixture 109 via spring 113. As will be appreciated by those of skill in the art this particular arrangement enables the body to rotate on the seals 111 and 112, however the body of the rotor could be bearing mounted with respect to the inlet fixture 109.

As noted above the rotor head 104 is fixed in sealing relation to the rotor body 105 The rotor head in this example is shape such that on engagement with the body forms a laminar flow chamber 114 which distributes the working fluid evenly to nozzles 115 which are disposed positioned tangential to the laminar flow chamber 114. The specific arrangement of the nozzles 115 is discussed in greater detail below with respect to FIG. 2. As shown the upper end of the head 104 includes a shaft 116 which extends beyond plate 1011 to enable the rotational energy of the rotor to be harnessed. As shown in this particular example the shaft 116 is positioned within mounting member 117 positioned within plate 1011.

In this instance, the mounting member 117 may be a rotary seal member similar to that of seal member 111 and is position against the upper face of the head 104. In such cases the shaft 116 is frictionally positioned within the mounting member 117 and is free to rotate within the seal member 117. While in the present example a friction mounting is utilised but it will be of course be appreciated by those of skill in the art the shaft could be bearing mounted within the mounting member 117 and/or support plate 1011.

In the present example the rotor 100 is designed to operate on the principle of expansion of working fluid from a high pressure environment to a low pressure environment outside the rotor to produce mechanical work. More specifically as a working fluid is fed to the rotor at an elevated pressure and/or temperature. As the working fluid flows through the rotor body 105 it enters the laminar flow chamber 114 within head 104, the fluid is then distributed via the laminar flow chamber 114 out of the nozzles 115. As the environment outside the head 104 is at a lower pressure and/or temperature than that of the working fluid filling the chamber 114 the resultant pressure differential along with the nozzle 115 size shape etc. causes the fluid to be ejected in as a high pressure stream thereby producing a driving force for the rotor.

While in the above discussed example it is desirable to prevent back flow of the working fluid from the laminar flow chamber 114 to ensure maximum utilisation of the potential energy of the fluid it will of course be appreciated by those of skill in the art that depending on the fluid utilised, a small amount of seepage into the body 105 and passage 107 about the seal may be desirable. For example, where the fluid is steam or a liquid the back flow of a small amount of fluid may be utilised to wet the passage 107 to thereby lubricate the rotor assembly 100.

Figure 2:
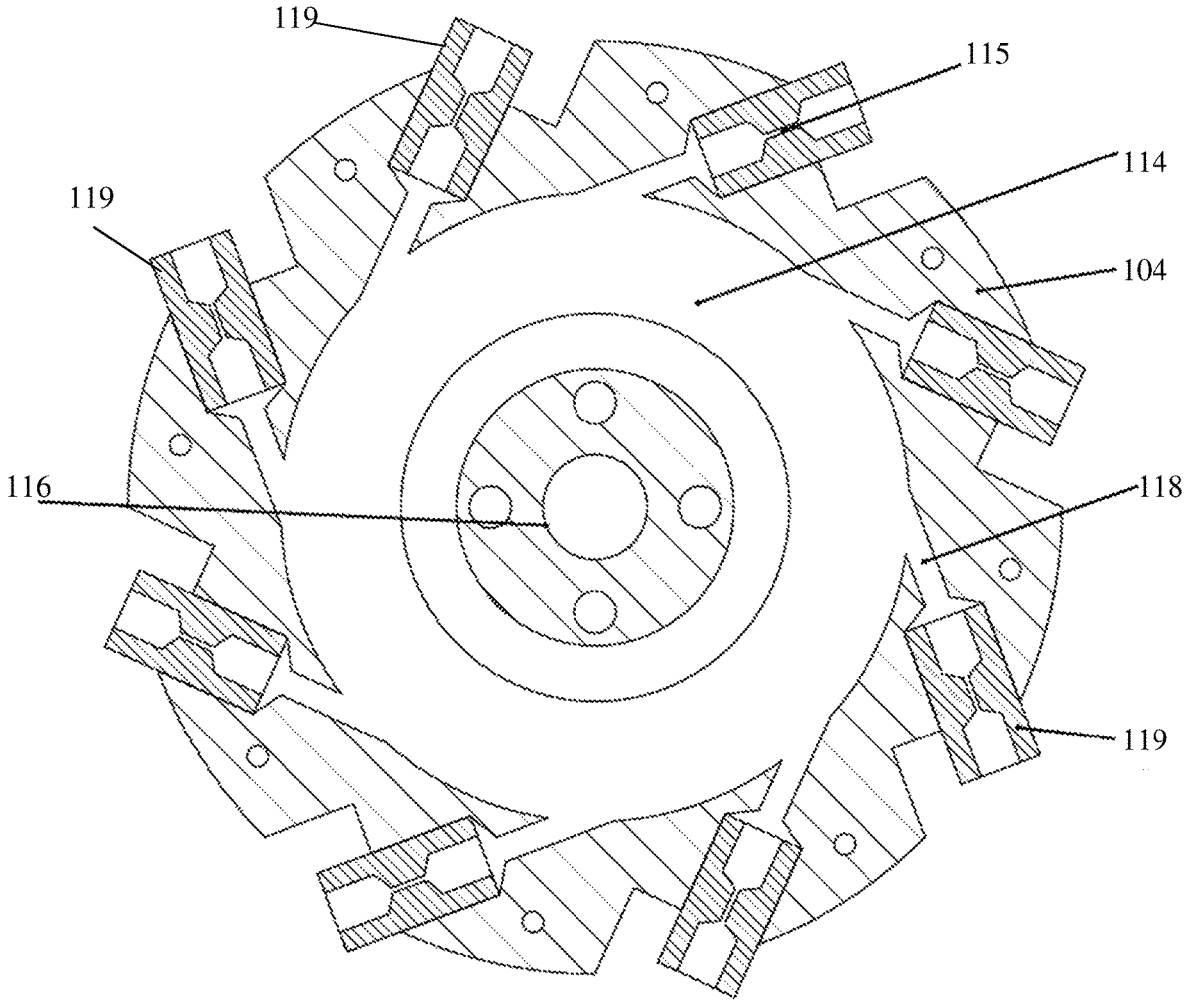
FIG. 2 is a plan cross sectional view of the rotor head for use in the rotor assembly of FIG. 1.

FIG. 2 depicts the construction of the head 104 in further detail. As shown the head 104 includes a plurality of nozzles 115. As can be seen the nozzles 115 are arranged in opposing nozzle sets with each nozzle 115 being coupled to the laminar flow chamber 114 in a contiguous manner via ejector tubes 118. The ejector tubes 118 in this example are disposed substantially tangential to the laminar flow chamber 114 (i.e. outer most edge of ejector tube is tangential to the circumference of the laminar flow chamber) so as to extract the maximum amount of thrust through each nozzle 115.

As can be seen in this instance the nozzles 115 include an adjustable head 119. The heads 119 can be adjusted to vary the rotational speed of the rotor. For example one or more of the nozzles could be open or closed or partially open (throttled) to vary the output of the working fluid and thereby adjust the working speed of the rotor and as a result the effective output power of the rotor.

As shown in FIG. 2 the rotor head is shaped in a manner so as to limit the amount of protrusions of the rotating part to assist in the noise reduction when in operation. More specifically the nozzles 115 are positioned such the heads 119 of each nozzle 115 terminate on or within the circumference of the rotor head 104. In addition to the reduction of noise produce by the rotor the positioning of the nozzles 115 in this manner also reduce drag on the rotor.

Figure 3:
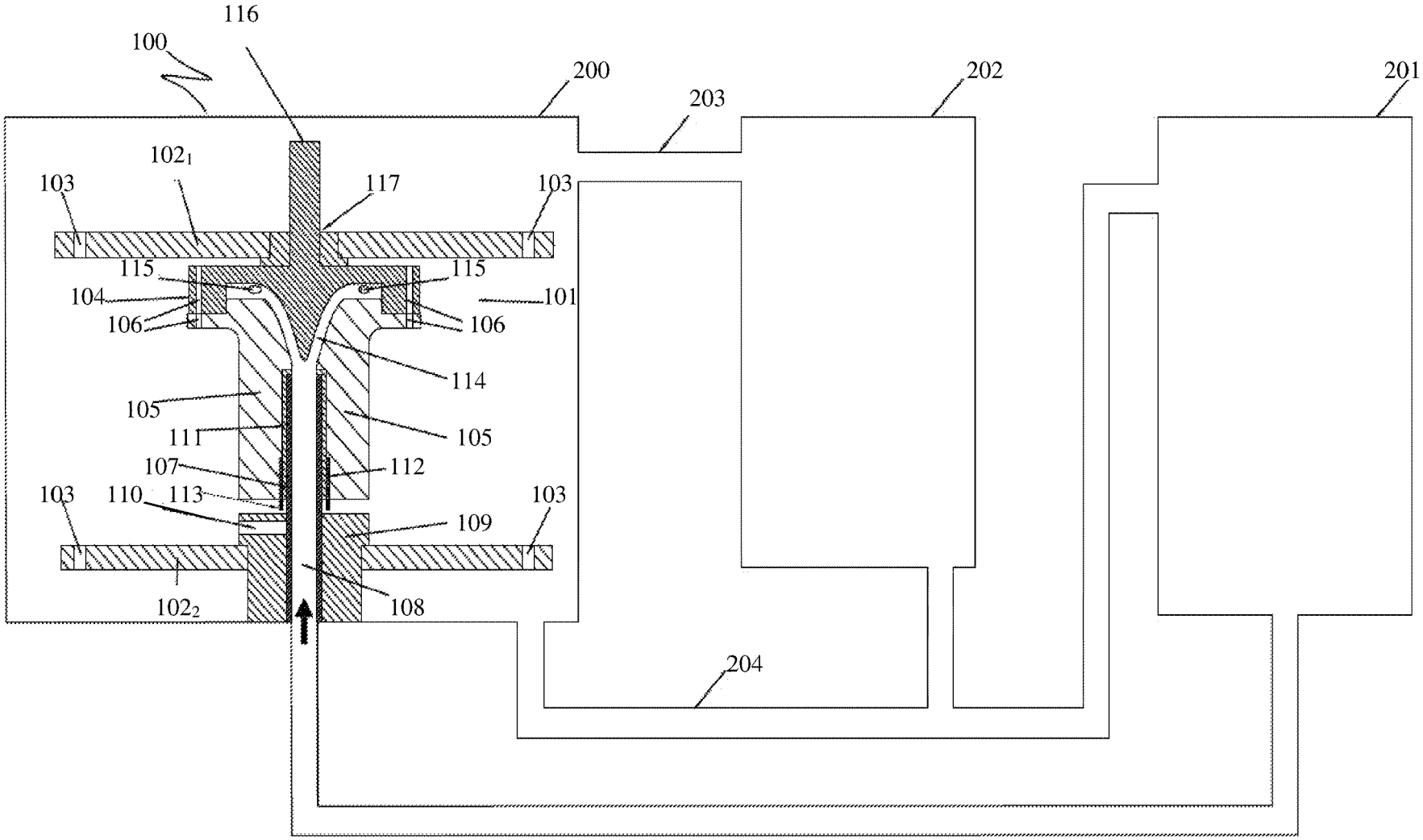
FIG. 3 is a schematic view of the rotor assembly mounted in situ within a steam turbine system.

With reference to FIG. 3 there is illustrated one possible configuration of a system for the production of mechanical work utilizing the rotor of FIGS. 1 and 2 above. The rotor in this example is configured operation with steam as the working fluid. It will be appreciated by those of skill in the art that the interconnection high pressure steam and the provision of additional fluid to the boiler requires the use of various auxiliary components such as pumps check valves relieve vales etc. and that for the purposes of clarity of description and the figures the use of these components is not discussed or shown.

As shown the rotor 100 in this instance is positioned within a housing 200. The fluid inlet member 108 is connected to boiler 201 enabling steam to be injected through the fluid inlet member 108 into the laminar flow chamber 114. The boiler 201 may be any suitable boiler such as a gas fired boiler, electric boiler, solar boiler etc. As the steam produced by the boiler is fed into the laminar flow chamber 114 it is ejected through ejector tubes 118 out nozzle head 119 causing the rotation of the rotor driving shaft 116.

As the steam is expelled from the rotor head 104 it fills the housing 200 the expelled steam may then be drawn off from the housing 200 to condenser 202 via line 203. The extracted steam is then recondensed and returned to the boiler 201. It will of course be appreciated by those of skill in the art that the condenser 202 in this instance need only provide sufficient cooling of the vapour to cause the phase transition back to liquid, there is no need for the condenser 202 to significantly cool the condensate before it return to the boiler. Indeed by not cooling the condensate prior to it return places less strain on the boiler due to the decreased temperature differential between the water in the boiler and the return feed.

Additional as the steam is expelled from the rotor it loses both pressure and temperature this cause some of the steam to recondense inside the housing this condensate can be extracted via line 204 and returned directly to the boiler.

In the above examples the rotor assembly 100 of the invention is depicted as being vertically mounted and rotating about a central vertical axis. As such the various components of the rotor are located about a central axis to allow balanced rotation and reduced wear on moving parts. It will of course be appreciated by those of skill in the art that while the above examples depict the rotor mounted for vertical operation the rotor could mounted horizontally without any substantive impact to its operation.

It is to be understood that the above embodiments have been provided only by way of exemplification of this invention, and that further modifications and improvements thereto, as would be apparent to persons skilled in the relevant art, are deemed to fall within the broad scope and ambit of the present invention described herein.

The invention claimed is:

1. A turbine including:

a rotor assembly having a circular head, a body adapted for engagement with the circular head to thereby form the rotor assembly with a cylindrical disc rotor head portion and an annular inlet portion, wherein the cylindrical disc rotor head portion has a diameter dimension and a thickness dimension that is less than the diameter dimension, said body including a passage for receipt of a working fluid, the passage being in communication with a flow chamber and a number of ejector tubes, the flow chamber and number of ejector tubes formed between the circular head and the body on engagement of the circular head with the body, characterised in that the circular head includes a plurality of working fluid exit nozzles at a radial edge of the circular head in a single plane, each of the plurality of working fluid exit nozzles is in fluid communication with the flow chamber to receive working fluid fed from the flow chamber using a respective one of the ejector tubes, the ejector tubes oriented tangentially to the flow chamber, with the respective working fluid exit nozzle aligned with the respective ejector tube and perpendicular to the passage;

wherein all of the exit nozzles are in a single plane; and, wherein each ejector tube is arcuate to produce a laminar flow of the working fluid through the ejector tubes up to the respective working fluid exit nozzle disposed in the circular head.

2. The turbine of claim 1 wherein the rotor assembly includes a working fluid inlet member for insertion into the passage, the working fluid inlet member having a centrally located channel therethrough to allow for the injection of the working fluid into the flow chamber.

3. The turbine of claim 2 wherein the working fluid inlet member is positioned within a positive displacement rotating seal provided within the passage.

4. The turbine of claim 2 wherein the rotor assembly is supported during rotation by the working fluid inlet member.

5. The turbine of claim 4 wherein the working fluid inlet member does not rotate when the rotor assembly is rotating.

6. The turbine of claim 1 wherein the ejector tubes are located tangential to the flow chamber.

7. The turbine of claim 1 wherein the working fluid exit nozzles are arranged in sets of opposing working fluid exit nozzle pairs spaced about the circular head.

8. The turbine of claim 1 wherein each working fluid exit nozzle includes an adjustable head.

9. The turbine of claim 8 wherein the adjustable heads are positioned so as to terminate within the radial edge of the circular head or adjacent to the radial edge of the circular head over the circumference of the head.

* * * * *